United States Patent [19]

Seiller

[11] 4,259,973

[45] Apr. 7, 1981

[54] CLASP FASTENER

[76] Inventor: Pierre F. X. Seiller, Proulieu, Lagnieu (Ain), France

[21] Appl. No.: 102,332

[22] Filed: Dec. 11, 1979

Related U.S. Application Data

[63] Continuation-in-part of Ser. No. 896,392, Apr. 14, 1978, Pat. No. 4,231,380.

[30] Foreign Application Priority Data

Apr. 15, 1977 [FR] France ..... 77 11970

[51] Int. Cl.[3] ..... A45D 8/00

[52] U.S. Cl. ..... 132/48 R

[58] Field of Search ..... 132/46, 48

[56] References Cited

U.S. PATENT DOCUMENTS

| | | | |
|---|---|---|---|
| 1,830,140 | 11/1931 | Sterling | 132/48 R |
| 2,116,799 | 5/1938 | Schneeweis | 132/48 R |
| 2,142,849 | 1/1939 | Huppert | 132/48 R |

*Primary Examiner*—G. E. McNeill

*Attorney, Agent, or Firm*—Karl F. Ross

[57] ABSTRACT

A clasp fastener of a barrette or other article of adornment in which a wire clip is hinged to a support, comprises a ball-shaped head formed with a base in one piece and anchored in the base by molding or the like. The legs of the clip are spread upon being thrust over the ball and lock around the neck of the latter. The base and neck are provided with one or more grooves extending the full length of the neck and facilitating the escape of gases upon implantation of the head in a plastic body.

6 Claims, 5 Drawing Figures

CLASP FASTENER

CROSS-REFERENCE TO RELATED APPLICATION

This application is a continuation-in-part of my copending application Ser. No 896,392 filed 14 Apr. 1978, now U.S. Pat. No. 4,231,380.

FIELD OF THE INVENTION

The present invention relates to a locking device for a clip of a barrette, hair retainer or other article of personal adornment or the like and, more particularly, to a ball retainer for the spreadable wire clip of any structure having a base upon which the clip member is hingedly mounted.

BACKGROUND OF THE INVENTION

Hair clips or barrettes are customarily provided with an esthetically pleasing base structure which is exposed to the observer and may have an esthetically pleasing pattern, design, coloration or the like. Such base elements are frequently molded from synthetic resin material and are formed at one end, on the reverse or unexposed side, with a hinge to which a wire clip member is secured, the free end of this member comprising a pair of spreadable wire shanks or legs which are thrust over a retaining body secured to the reverse side of the base at the other end thereof. The inherent resiliency of the clip member causes the two legs to straddle this retainer until the user draws the clip member over the retainer in the opposite direction to release the barrette.

The clip member is thus constituted as an arm hinged at one end and formed from a spring metal wire which is closed to form a complete but elongated loop. In other words, the ends of the wire are bent to form the pintle of the hinge while the bight of the wire remote from the hinge connects a pair of shanks or legs which can be forced over the retainer to straddle a neck thereof.

The retainer which holds the arm in its closed position can be a locking ball or bulbous member fixed to the body or base of the barrette and projecting from the rear surface thereof so that the legs of the arm can be forced over the large portion or head of this member to ultimately straddle the neck. Traditionally, this type of retainer has been made by die-stamping or swaging a metal piece of limited thickness. The head is thus formed as a hollow member with a central cavity and associated openings.

This method of fabricating the retaining member is not compatible with modern automatic feed processes for machines adapted to produce barrettes and the like by mass production modes of operation. For example, such hollow sheet metal structures tend to jam in the feed slides because of the penetration of a part of one retainer into an opening in the other. Finally, in this connection, mention must be made of the fact that die-stamping techniques of the type hitherto used for producing such small elements have not been able to fabricate them with the desired degree of precision or accuracy, i.e. with very precise dimensions. Such precision is desired where the retaining member must be very small for fine products.

OBJECTS OF THE INVENTION

It is the principal object of the present invention to provide a retainer for a barrette or other structure of the type described which avoids the disadvantages of the earlier device of this type.

Still another object of the invention is to provide a clip closure or latching assembly for barrettes and the like which can be made with high dimensional precision.

A further object of the present invention is to extend the principles set forth in the above-identified application by improving the ability to rapidly assemble sturdy barrettes in accordance with the techniques described in the aforementioned copending application.

SUMMARY OF THE INVENTION

These objects and others which will become apparent hereinafter are attained, in accordance with the present invention, in a retainer for engagement by the wire clip of a barrette or the like in which the retainer comprises a base adapted to be embedded in the structure onto which it is to be mounted and which forms a unitarily one-piece body of a metal or an alloy with the ball or bulb and the neck. The locking element is produced by turning, injection molding, die-casting or the like.

The retainer, being solid, is free from openings, cavities, projections and the like so that it is able to be fed automatically by machine without any difficulty. Furthermore, the aforementioned modes of manufacture ensure that the structure will have precise dimensions.

According to a particular embodiment of the invention, the base of the retainer is of square configuration which prevents its rolling and facilitates its engagement and handling with manual mounting. Furthermore, the square base enables it to be guided with precision to the point at which it is to be embedded in the structure.

Advantageously, the base is formed with a central tip of its face opposite the head so that the base has no tendency to slide on the body of the barrette, usually formed of a synthetic-resin material, during the implantation of the retainer in this body.

As noted above, a key point of the invention described in my application Ser. No. 896,392 is that the ball or retainer to be implanted in the synthetic-resin body of the barrette has its head connected by a generally cylindrical neck to a base which extends transversely to the axis of the neck and head and which is formed, on its side turned away from the head, with a pointed formation that facilitates positioning of the retainer and guides material of the barrette body outwardly around the sides of the square base as the latter is thrust into the synthetic-resin body.

While this system has been found to be highly desirable, efforts have been expended to improve the ease of insertion of the retainer in the barrette body and improving the retention of the retainer against various forces that develop when the barrette is used.

The complications may result from the fact that, when the base is heated, bubbles of gas may be released from the synthetic- resin material which are trapped below the base upon insertion and which may result in a premature loosening or unsatisfactory implantation of the retainer.

These are avoided with the system of the present invention by forming the base with at least one groove, slot or split which extends transversely to the base and which can lie in a plane perpendicular to the base and preferably extends the full length of the aforementioned neck, i.e. the part of the retainer lying between the base and the head which can have the pear-shaped structure preferred in the aforementioned copending application.

Thus, especially when two such grooves are provided at diametrically opposite locations and preferably along a common diagonal of the square base, the retainer can be implanted in the soft plastic without any excessive pressure so that distortion of the retainer and dislocation thereof can be avoided. The groove, slot or like formation has been found to greatly accelerate the cooling of the body after its insertion in a hot state, thereby reducing the evolution of gases, while any gases which may be evolved can be conducted away from the base rapidly by the groove.

When two such grooves or slots are provided, they are located diametrically opposite one another in a common plane.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 1:
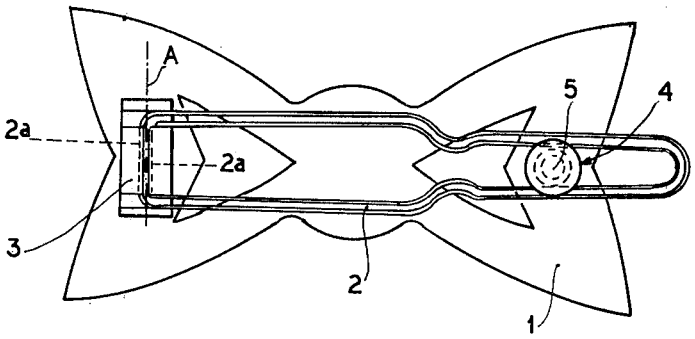
FIG. 1 is a rear elevational view of a hair barrette or clip provided with a latching system according to the present invention.
Figure 2:
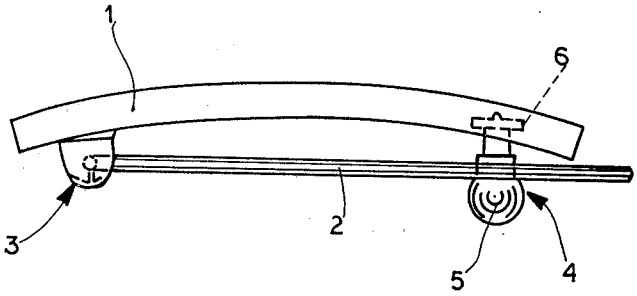
FIG. 2 is a side elevational view of a barrette in its closed condition.

FIGS. 1 and 2 show the overall construction of a hair clip or barrette in accordance with the present invention and which, apart from the construction of the retaining member, is of known type. This barrette comprises a principal element or body 1 of synthetic-resin material and of an esthetically pleasing configuration or color here shown to be the configuration of a body. The body 1 is concave inwardly (see FIG. 2) with the bend being spanned by the clip member 2 or arm. The latter constitutes the element which is thrust beneath the hair to secure the barrette in place.

The arm 2 is swingably mounted on the body 1 by means of a hinge 3 and, more particularly, has inwardly bent feet which form the pintle of the hinge 3. The hinge 3 in anchored to one end of the body 1 on the reverse or concave side thereof.

The arm 2 is formed by a spring metal wire of hairpin shape as shown and thus has a certain elasticity which permits the free end to be thrust over a retaining member 4 affixed to the element 1 at its end opposite that which is provided with the hinge 3.

In the region of the hinge 3 the two extremities or legs of the arm 2 are bent substantially at right angles to form the aforementioned feet 2*a* which define the pivot axis A of the hinge.

Figure 3:
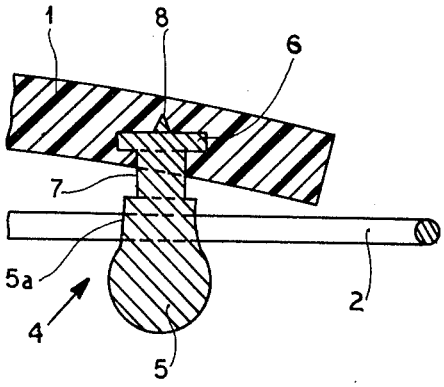
FIG. 3 is a partial cross-sectional view drawn to an enlarged scale of the barrette.

The present invention is concerned particularly with the configuration of the retaining member 4 best shown in FIG. 3.

The retaining member 4 comprises a ball-shaped head 5, which also may be termed a bulb, i.e. a pear-shaped form so that a neck 5*a* is formed inwardly of the ball 5 and is connected by a cylindrical shank 7 to a base 6 extending perpendicular to the axis of the retaining member 4. The generally planar base 6 has a square configuration and is formed on its face opposite the shank 7 with a central tip or thorn 8 whose purpose has been described previously. The entire structure 5, 5*a*, 6, 7, 8 is formed unitarily, i.e. in a monoblock, from solid metal or a die-casting alloy such as Zamac.

The retaining member 4 is adapted to be set in a hot state in the body 1 of the barrette which is composed of thermoplastic materials so that the base 6 is embedded in the element 1, the tip 8 assuring precise positioning of the member 4 until it has been anchored in place. In its perpendicular position (see FIG. 3) the neck 5*a* of the ball 5 can be straddled by the legs of the arm 2.

While the system has been described in terms of a barrette or hair clip it will be understood that it is not limited thereto except as otherwise claimed, and may be used wherever retaining balls are straddled by spring clip members.

The hinge can be of the type described in my other copending application Ser. No. 896,393 filed concurrently with the aforementioned application Ser. No. 896,392.

Figure 4:
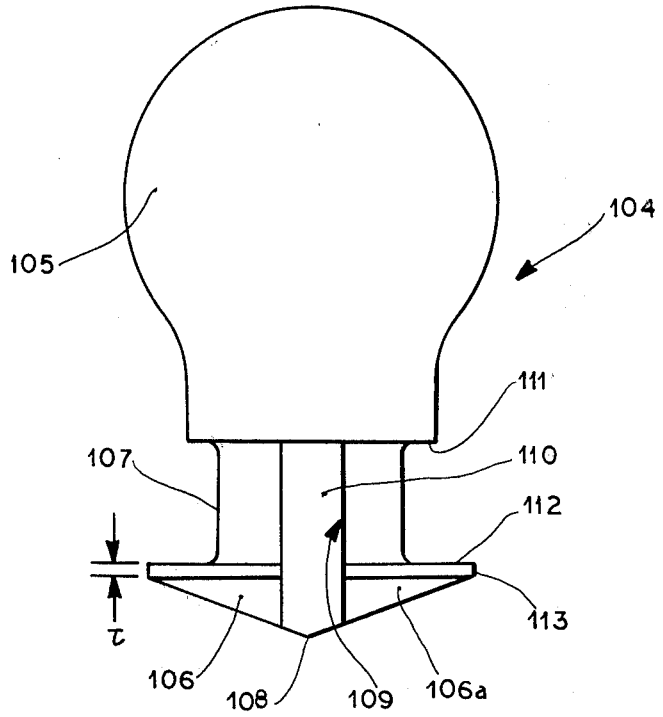
FIG. 4 is an elevational view of a retainer which can be substituted for the retainer shown in FIG. 3 and drawn to a larger scale than the retainer of that Figure.
Figure 5:
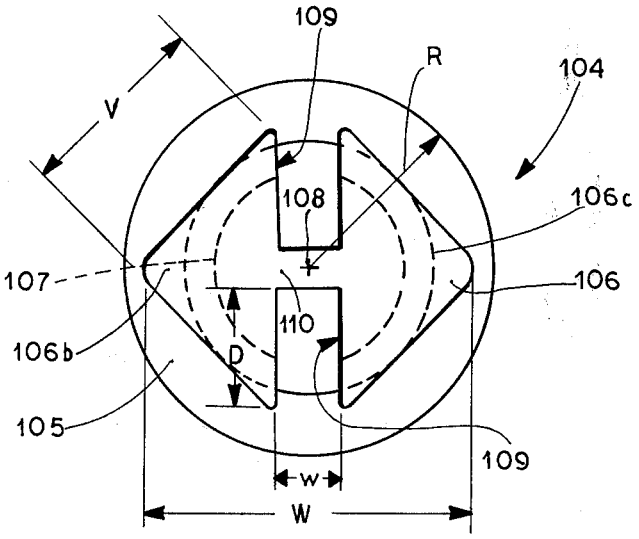
FIG. 5 is a bottom view of this retainer.

The retainer 104 shown in FIGS. 4 and 5 is adapted to be substituted in the barrette structure for the retainer 4 shown in FIG. 3 and comprises, as has been described in connection with FIGS. 1 through 3, a pear-shaped head 105 terminating in a planar shoulder 111 perpendicular to the axis of the retainer which is vertical in FIG. 4.

A cylindrical neck 107 of a diameter less than that of the shoulder 111, connects the head 105 with a base 106 of generally square configuration as viewed in projection on a plane perpendicular to the plane of the axis, i.e. as can be seen in FIG. 5. The central point 108 on this base, unlike the projection 8 of FIG. 3, is formed by uniformly converging faces 106*a* etc. of the triangular portions 106*b*, 106*c* formed by the base 106. Effectively, therefore, the face of the base turned away from the head 105 can be pyramidal.

This retainer is formed in one piece and is adapted to be seated in the plastic body of the barrette in the manner previously described.

A pair of grooves 109 are provided diametrically opposite one another and in the same axial plane of the retainer perpendicular to the base 106 and lying along one of the diagonals of the square. The grooves approach one another in the point or vertex 108 and thereby subdivide the base into the triangular parts. Naturally, the surfaces 106*a* can also be conical sections converging toward the point or vertex 108. The grooves 109 extend the full height of the neck 107 and are separated by a web 110 formed with the point 108.

The grooves facilitate the release of gases, promote cooling and provide additional anchoring surfaces in the manner described.

Naturally, a single groove can be used in place of the pair of grooves shown, or more than two grooves can be provided, if desired, within the ambit of the present invention.

Furthermore, the invention is not limited to barrettes but can be used wherever retainer heads are required for cooperation with hairpin-like clips.

Preferably, the length of a side of a square L is slightly larger (say 5 to 20% larger) than the radius R of the head 105 while the width W of the base along a diagonal thereof is 4 to 8 times larger than the width w of the groove. The depth D of the groove can be between one-fourth and two-fifths of the diagonal dimension W. The base 106 can have a shoulder 112 lying in a plane parallel to the plane of the shoulder 111 and can have a limited thickness portion 113 before the convergence begins, this limited thickness portion being represented at t and having a thickness which is between one-eighth and one-twentieth of the altitude of the point.

I claim:

1. A retaining member for a spring clip comprising a unitary body formed with:

a generally ball-shaped head having a narrow portion;

a cylindrical neck connected to said head at said narrow portion and extending along an axis of said head;

a substantially planar base of generally square configuration connected to said neck in a plane perpendicular to said axis;

a point formed on said base along a side thereof turned away from said head; and at least one groove lying in a plane perpendicular to said base and formed therein and in said neck at least to a portion thereof adapted to project out of a structure in which said base is to be embedded.

2. The retaining member defined in claim 1 wherein two such grooves are formed in said base and in said neck in a common plane along a diagonal of the base, said grooves being separated by a web of material formed with the point.

3. The retaining member defined in claim 1 or claim 2 wherein each groove extends the full length of said neck and terminates at a shoulder formed between said head and said neck.

4. A hairclip comprising:

an elongated body of synthetic-resin material having an obverse side and a reverse side;

a hinge mounted on said reverse side of said body at one end thereof;

a hairpin-shaped bent wire arm swingably mounted at one end on said hinge and having a free end formed with a pair of legs resiliently deflectable outwardly; and a retaining member anchored in said body on said reverse side at an end of the body remote from said hinge, said retaining member comprising:

a pear-shaped head having a narrow portion extending along an axis of said head and terminating in a shoulder lying in a plane perpendicular to said axis, a cylindrical neck unitary with said head at said narrow end and extending along said axis, a substantially square base unitary with said neck and lying in a plane perpendicular to said axis, the surface of said base turned away from said head converging to a point at said axis, and a pair of grooves formed in said base along a common diagonal of said square and extending along said neck, said base and a portion of said neck being embedded in said body, said grooves extending along said neck beyond the point to which said neck is embedded in said body.

5. The hairclip defined in claim 4 wherein said grooves are of rectangular cross section and define a web between them, said web being formed with said point.

6. The hairclip defined in claim 4 or claim 5 wherein said grooves extend the full length of said neck.

* * * * *

UNITED STATES PATENT AND TRADEMARK OFFICE

CERTIFICATE OF CORRECTION

PATENT NO. : 4,259,973

DATED : April 7, 1981

INVENTOR(S) : Pierre F. X. Seiller

It is certified that error appears in the above—identified patent and that said Letters Patent is hereby corrected as shown below:

The term of this patent subsequent to November 4, 1997, has been disclaimed.

Signed and Sealed this

*Seventh* Day of *July 1981*

[SEAL]

*Attest:*

RENE D. TEGTMEYER

*Attesting Officer*

*Acting Commissioner of Patents and Trademarks*